US009679445B2

(12) United States Patent
Harrelson et al.

(10) Patent No.: US 9,679,445 B2
(45) Date of Patent: Jun. 13, 2017

(54) METHOD, APPARATUS, AND PROGRAM PRODUCT FOR PROVIDING ALTERNATIVE WIN OPPORTUNITIES WITH WILD SYMBOLS IN A WAGERING GAME

(71) Applicant: EVERI GAMES INC., Austin, TX (US)

(72) Inventors: Eric Neal Harrelson, Austin, TX (US); Jennifer Skaggs, Austin, TX (US); Michael Casey, Austin, TX (US)

(73) Assignee: Everi Games Inc., Austin, TX (US)

( * ) Notice: Subject to any disclaimer, the term of this patent is extended or adjusted under 35 U.S.C. 154(b) by 168 days.

(21) Appl. No.: 14/317,068

(22) Filed: Jun. 27, 2014

(65) Prior Publication Data

US 2015/0379805 A1 Dec. 31, 2015

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3258* (2013.01); *G07F 17/3262* (2013.01)

(58) Field of Classification Search

CPC ..... G07F 17/3213; G07F 17/3258; G07F 17/326; G07F 17/34; G07F 17/3262

See application file for complete search history.

(56) References Cited

U.S. PATENT DOCUMENTS

2003/0222402 A1* 12/2003 Olive ..... G07F 17/32 273/292
2009/0029762 A1* 1/2009 Tsukahara ..... G07F 17/3202 463/20
2009/0258697 A1* 10/2009 Kelly ..... G07F 17/3211 463/20
2010/0093422 A1* 4/2010 Gomez ..... G07F 17/3258 463/20
2012/0021816 A1* 1/2012 Aoki ..... G07F 17/3262 463/20
2012/0094738 A1* 4/2012 Aoki ..... G07F 17/34 463/20
2015/0080116 A1* 3/2015 Jhanb ..... G07F 17/3267 463/27

* cited by examiner

*Primary Examiner* — Steve Rowland
(74) *Attorney, Agent, or Firm* — Nathan Culvert, Esq.; Russell D. Culbertson, Esq.; J P Cody, Esq.

(57) ABSTRACT

A reel-type wagering game includes at least one wild symbol in the game symbol set. The wild symbol or symbols may appear at multiple game symbol locations across an array of game symbol locations through which results are shown for a play in the game, and may assist in forming winning combinations of game symbols along pay lines. Wild symbols that appear in the array of game symbols for a play of the game, but do not contribute to any winning combination along a pay line, represent noncontributing wild symbols which may provide an alternate winning result for the given play of the wagering game.

14 Claims, 11 Drawing Sheets

METHOD, APPARATUS, AND PROGRAM PRODUCT FOR PROVIDING ALTERNATIVE WIN OPPORTUNITIES WITH WILD SYMBOLS IN A WAGERING GAME

TECHNICAL FIELD OF THE INVENTION

The invention is related to wagering games, particularly reel-type wagering games, in which wild symbols may provide alternative means for winning beyond pay line wins. The invention encompasses methods, gaming machines and systems, and corresponding program products.

BACKGROUND OF THE INVENTION

Numerous different types of reel-type gaming machines have been developed to provide desirable game features and play characteristics in these types of wagering games. As used in this disclosure and the accompanying claims, a reel-type gaming machine comprises a gaming machine in which at least some results are displayed to the player in the form of an array of game symbols, where each game symbol is displayed on the periphery of a spinnable reel, either a physical reel or a video simulation of such a reel. For example, a reel-type gaming machine may include a display system with five adjacent reels (either physical reels or video simulations) all aligned along a horizontal axis of rotation, with each reel showing a line of three or more game symbols in the array of symbols. Other reel-type gaming machines may show only a single symbol on each physical or simulated reel and include a separate physical or simulated reel for each symbol location in the array of game symbols used to display results. In all of these reel-type gaming machines, winning results are shown at least partially by the particular pattern or patterns of game symbols appearing in the array of game symbols for a given play of the game.

Some reel-type games include wild symbols in the set of game symbols used to populate the array of game symbols for a given play of the game. A wild symbol is a symbol which has the property that it may represent any one of a number of different game symbols as necessary to make a winning combination of game symbols. For example, a reel-type game may include a pay table which defines a number of different prize levels in terms of combinations of game symbols aligned along a pay line of game symbols through the array of game symbols. In this example, a prize may be awarded when the array of game symbols produced for a play of the game shows three "X" game symbols aligned along a pay line defined for the game. If an array of game symbols produced for a play of the game shows two "X" game symbols and one wild symbol aligned along the pay line, the wild symbol will count as an "X" game symbol to make a winning combination of three "X" symbols along that pay line. Because pay lines may be non-linear and different pay lines may cross at a given game symbol in the array of game symbols produced for a play of the game, it is possible for a wild symbol to represent multiple different game symbols in the same play of the game.

Although wild symbols are commonly used in reel-type games, wild symbols can frustrate a player in certain situations. In particular, in view of their ability to assist in producing winning game symbol combinations, wild symbols carry with them a certain degree of expectation that they will in fact produce winning combinations. If wild symbols routinely appear in the various arrays of game symbols produced over the course of a number of plays in a reel-type game, but happen to be positioned in the array so that they do not contribute to a winning combination, the perceived value of the wild symbol may be reduced and the player may become frustrated at seeing the wild symbols appear for a play only to find that they are in the wrong position to contribute to a winning combination of game symbols.

SUMMARY OF THE INVENTION

The present invention provides a feature for a reel-type wagering game which includes at least one wild symbol in the game symbol set. The wild symbol or symbols may appear at multiple game symbol locations across an array of game symbol locations through which results are shown for a play in the game, and may form winning combinations of game symbols along pay lines similarly to prior art wild symbols. According to the present invention, any wild symbols that appear in the array of symbol locations but do not contribute to a pay line win represent noncontributing wild symbols which may provide an alternate winning result for a given play of the wagering game. This capability of providing an alternative winning result makes the game more exciting and enjoyable to players and helps stem frustration when the wild symbols appear in an array of game symbol locations but do not contribute to any pay line win.

A method for operating a gaming machine according to an illustrative embodiment of the invention includes receiving a play input through a player input system of a gaming machine to initiate a play in a wagering game. In the course of the play in the wagering game, the method includes controlling a display system of the gaming machine to populate at least some game symbol locations of an array of game symbol locations. The game symbol locations are each populated with a respective game symbol selected from a set of game symbols, and this set includes a wild symbol which may appear multiple times in the array of game symbol locations. As in prior art reel-type games, a pay line prize is awarded for each winning combination of game symbols appearing along an active pay line defined through the array of game symbol locations. The various winning combinations of game symbols and the respective prize correlated to each combination are defined in a pay table for the wagering game, and the wild symbol may function as a standard wild symbol to contribute to a winning combination of game symbols along a pay line.

In addition to contributing to winning combinations of game symbols aligned along a pay line, wild symbols which do not contribute to a pay line win may also serve as noncontributing wild symbols to provide additional prizes. In particular, methods according to the present invention include awarding a respective noncontributing wild symbol prize for each set of noncontributing wild symbols meeting one of one or more noncontributing wild symbol prize definitions for the wagering game. A noncontributing wild symbol comprises a wild symbol appearing in the populated array of game symbol locations for the play in the wagering game which is not included in any winning combination of game symbols appearing along an active pay line for that play.

A gaming machine according to some embodiments of the present invention includes a display system which may be controlled to produce the arrays of game symbols for the various plays of the game, a player input system which allows a player to initiate a play in the game, at least one processor, and at least one memory device storing instructions executable by the one or more processors. The processor or processors operate under the control of the instructions to perform the process steps described above. In particular, the instructions are executable by the one or more processors to receive the game play input through the player input system, control the display system to populate at least some game symbol locations of an array of game symbol locations to produce an array of game symbols for the play of the game, and award both pay line prizes and noncontributing wild symbol prizes.

Considering that the present invention may be implemented using one or more general purpose processors, the invention also encompasses program products comprising tangible and non-transitory computer readable data storage devices storing program code. The stored program code may include player input program code, game program code, and payout program code. The player input program code is executable to receive a game play input entered through the player input system to initiate a play in a wagering game, while the game program code is executable to cause the display system of the gaming machine to produce the array of game symbols for a given play of the game. The payout program code is executable to cause the gaming machine to award both pay line prizes and noncontributing wild symbol prizes as described above.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-3 will be used to describe example gaming machines and gaming networks through which the present invention may be implemented. Processes which are illustrative of various embodiments of the invention will then be described in connection with the flow chart of FIG. 4. FIGS. 5-11 will then be used to describe various graphic game displays which may be presented according to embodiments of the present invention.

Figure 1:
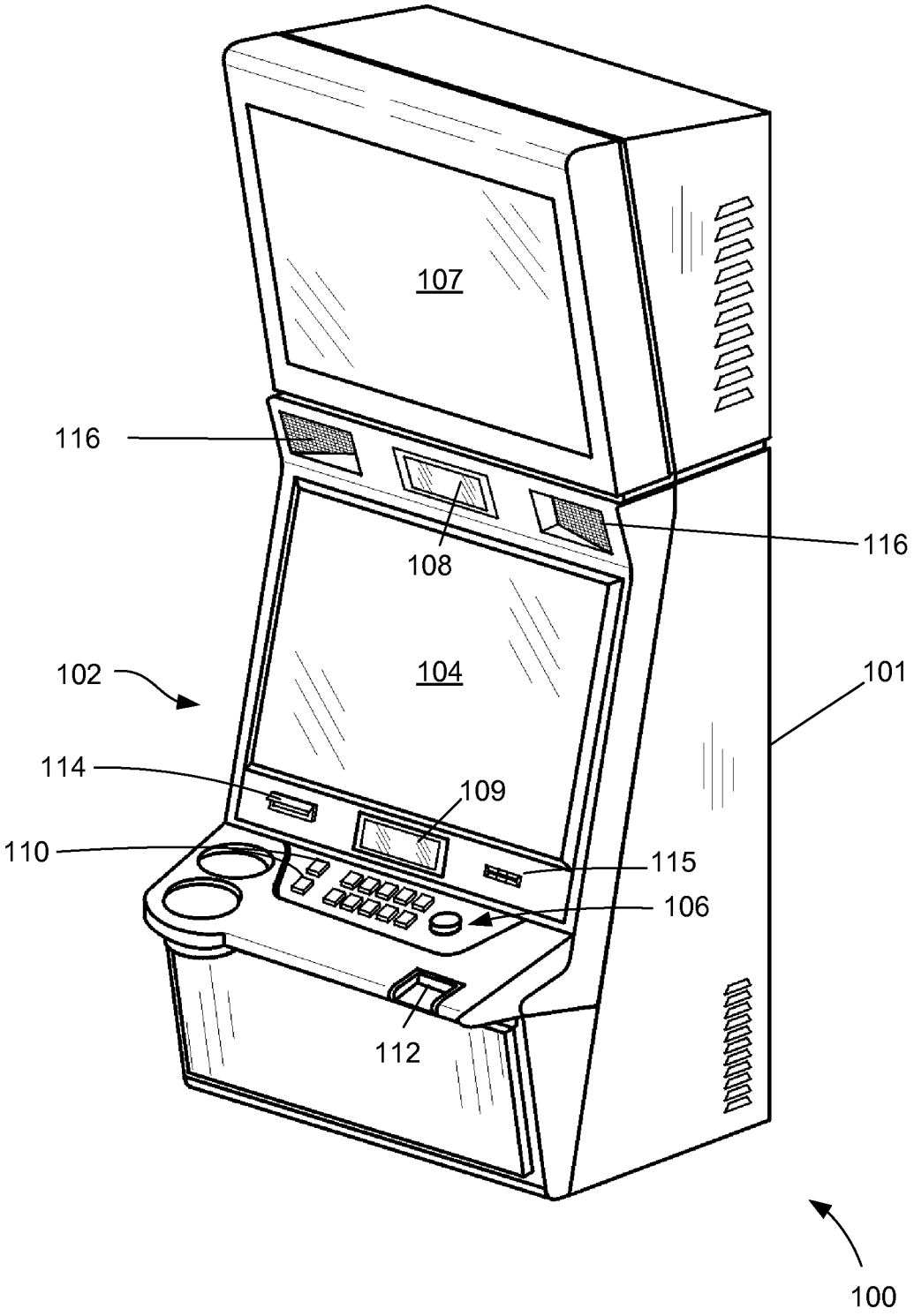
FIG. 1 is a view in perspective of a gaming machine which may be employed to implement various embodiments of the present invention.

FIG. 1 shows a gaming machine 100 that may be used in implementing a wagering game utilizing a play extending process according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to implement a game play according to the present invention. As will be described further below in connection with FIG. 2 and elsewhere, it is also possible for gaming machines within the scope of the present invention to include mechanical elements such as mechanical reels. In these mechanical reel implementations, the mechanical reels may be used to display results of a game play according to embodiments of the present invention. Generally, the display device or display devices of the gaming machine, whether video display devices, mechanical devices, or combinations of the two, which are used to display games according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a wager level, select pay lines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls included on button panel 106. The player interface devices which receive player inputs in the course of a game played through the gaming machine, such as controls to select a wager amount for a given play, controls to enter a play input to actually start a given play in the wagering game, or controls to allow a player to make other player selections in a game according to the present invention, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
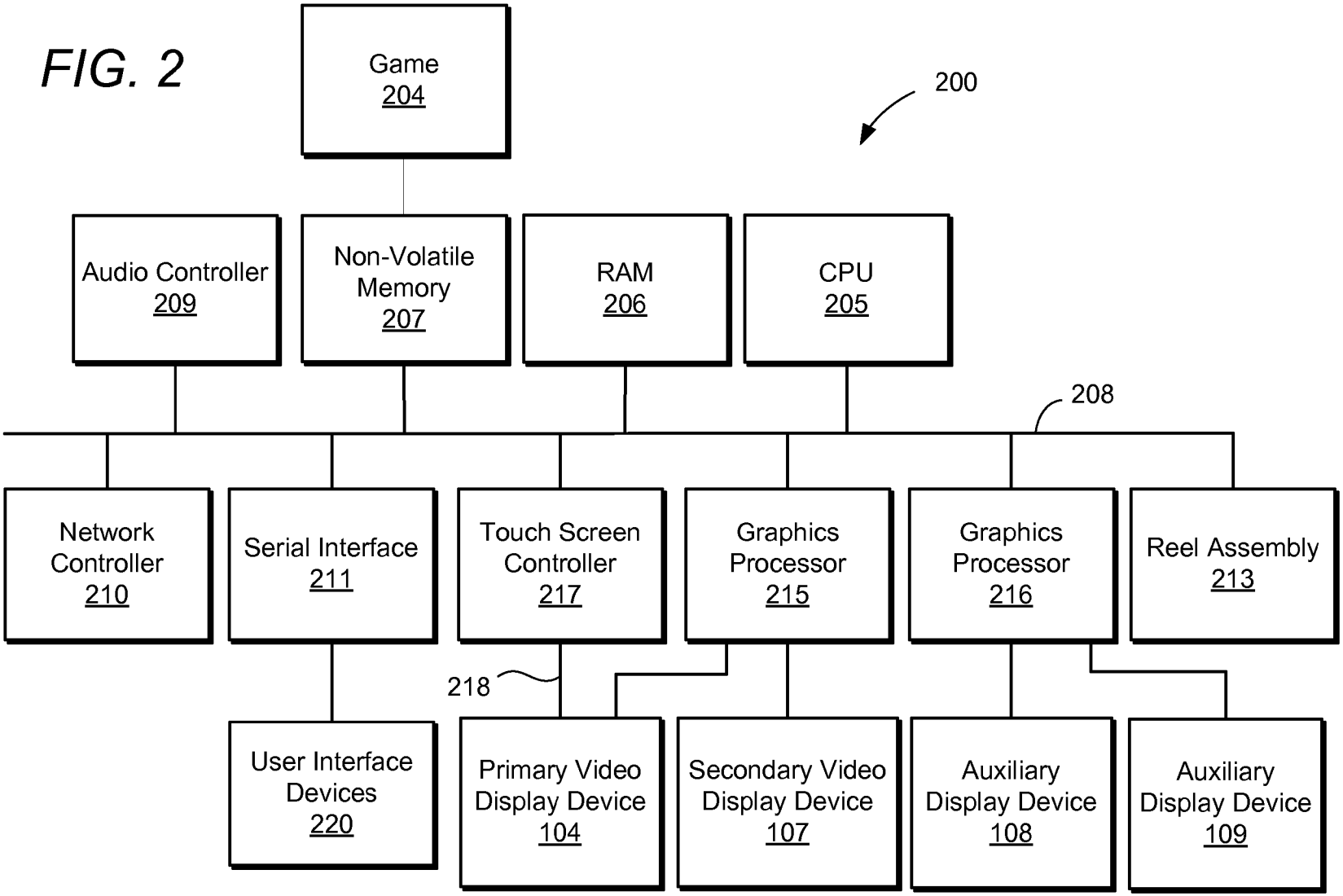
FIG. 2 is a diagrammatic representation of the gaming machine shown in FIG. 1 showing various components of the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a standalone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the player input program code, game program code, and award program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel® Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the present invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
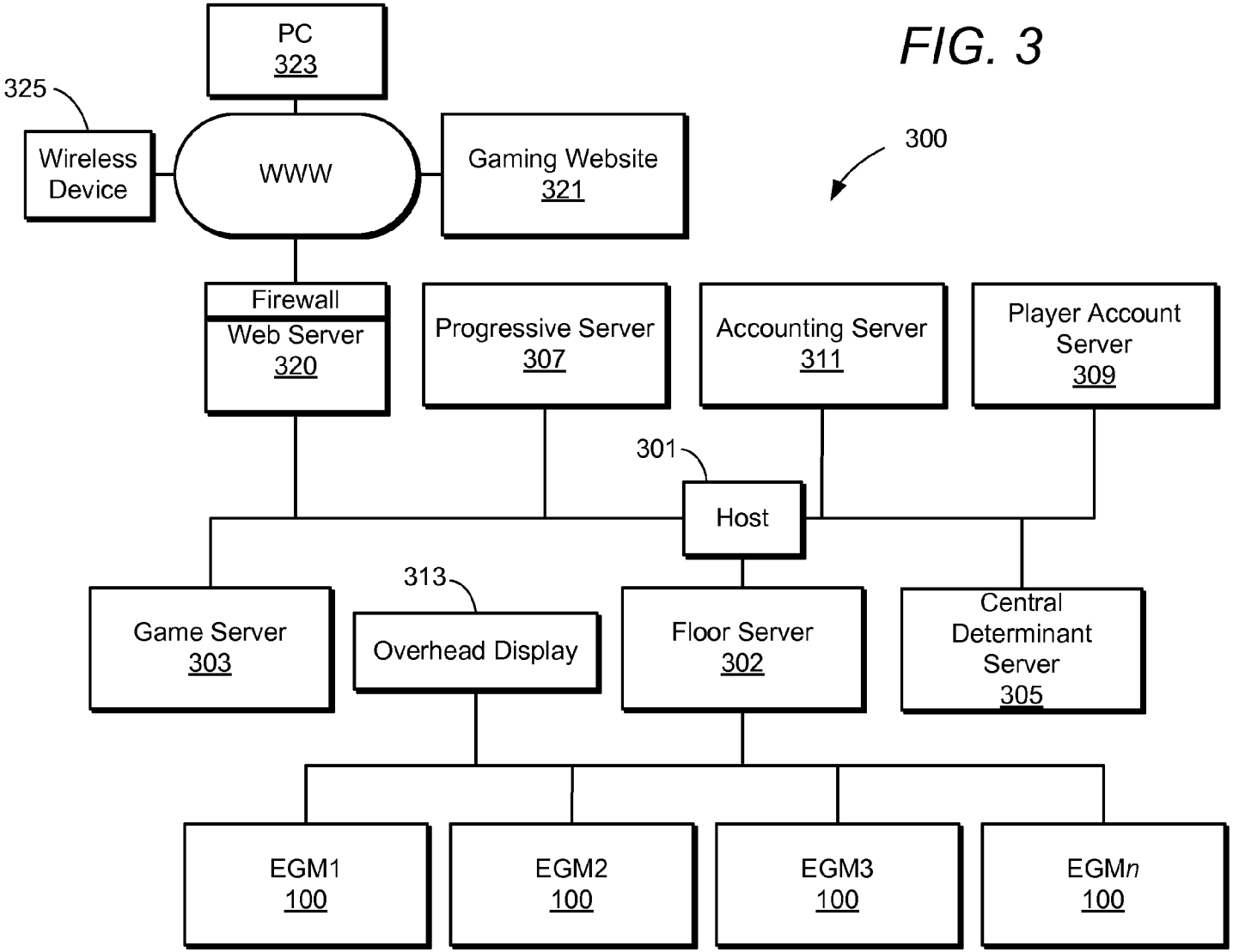
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a game play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Progressive server 307 may maintain progressive pools for progressive games which may be available through the various gaming machines 100. In particular, progressive server may maintain various tiers of progressive pools which may serve as prizes for the various noncontributing wild symbol wins defined for a game according to the present invention. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including games according to the invention. Also website 321 may allow the player to make various personalizing selections and save the information so it is available for use during the player's next gaming session at a casino establishment having the gaming machines 100.

Gaming network 300 illustrated in FIG. 3 is provided merely as an example of a gaming network in which wagering games featuring noncontributing wild symbol prizes according to embodiments of the present invention may be implemented, and is not intended to be limiting in any way. The invention is not limited to use in games offered through a gaming network (via the gaming website 321, or via gaming machines such as gaming machines 100, or otherwise). For example, games incorporating noncontributing wild symbol prizes according to the present invention may be offered through a stand-alone gaming machine having a configuration similar to gaming machine 100 or having any other gaming machine configuration. Also, where games offering noncontributing wild symbol prizes as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
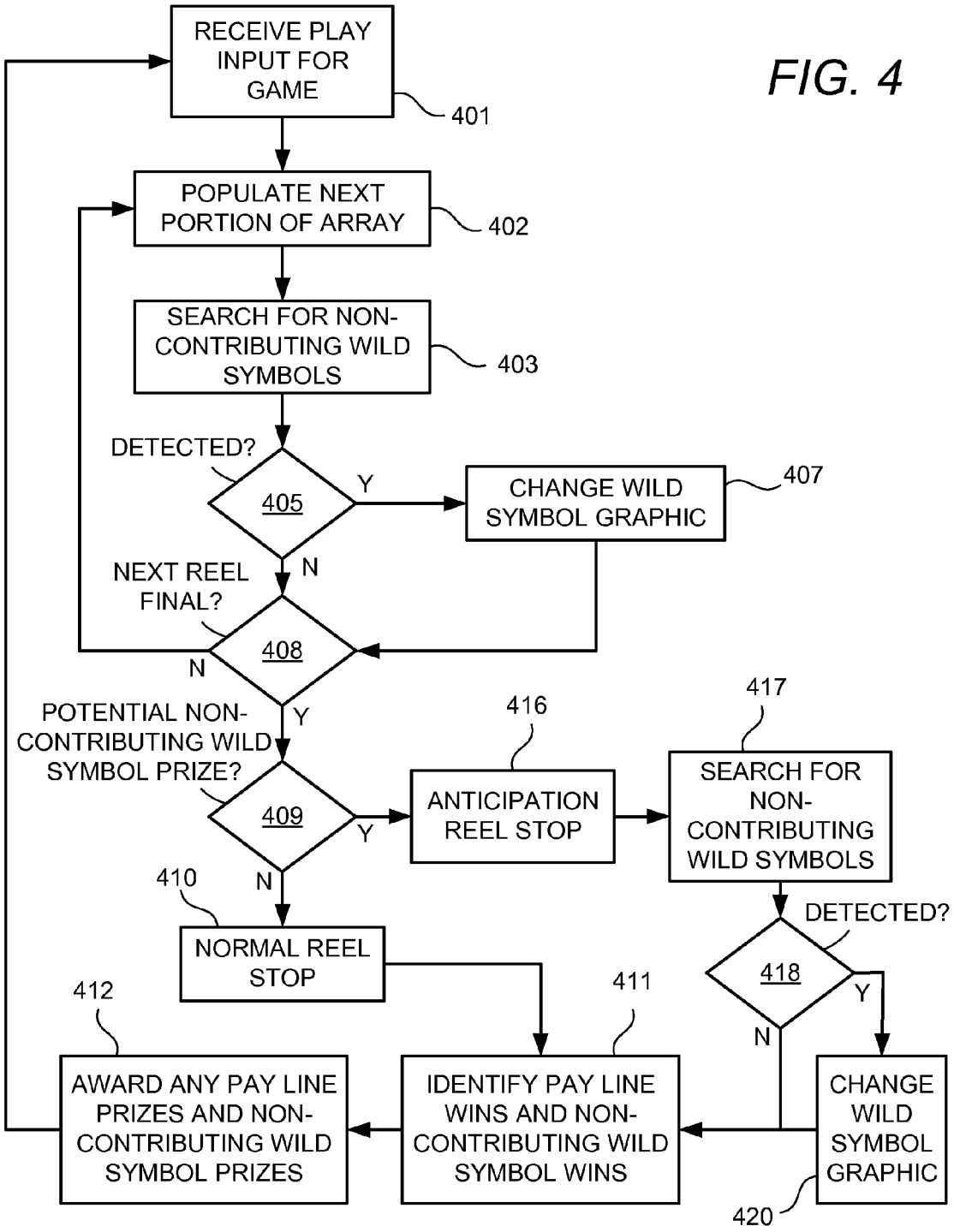
FIG. 4 is a flow diagram illustrating process steps according to one or more embodiments of the present invention.

FIG. 4 comprises a process flow diagram showing an example process within the scope of the present invention. The process begins by receiving a play input for a play in a wagering game as shown in a process block 401. The illustrative process also includes populating a next portion of an array of game symbol locations as shown at process block 402. This populating step is preferably accomplished by spinning a series of reels of a reel-type game, and then bringing the reels to a stop to show game symbols in the various symbol locations of the array. The illustrated method further includes at process block 403, searching for any noncontributing wild symbols which are displayed in the portion of the array populated at process block 402. If any noncontributing wild symbols are detected as indicated by an affirmative outcome at decision block 405, the process changes the wild symbol graphic as indicated at process block 407. After the change in symbol graphic at process block 407 or if no noncontributing wild symbol is detected at decision block 405, the process loops back to populate a next portion of the array in the event the next reel to be brought to a stop is not the final reel for the play in the game as indicated at decision box 408. However, if the next reel to be stopped for the game play is the final reel, it is determined whether the current state of the array of game symbols indicates the potential for any noncontributing wild symbol prize. If not, the illustrative process in FIG. 4 simply stops the final reel in the normal fashion as indicated at process block 410 and then the process identifies pay line wins as indicated at process block 411 and finally awards prizes for those pay line wins as indicated a process block 412. The process then loops back to receive the next play input for another play in the game at process block 401.

If the current state of the array of game symbols immediately before the final reel is stopped indicates the potential for a noncontributing wild symbol prize at decision box 409, the illustrated process conducts an anticipation reel stop for the final reel as indicated at process block 416. There is then a final search for any noncontributing wild symbols placed in the array by that last reel as indicated at process block 417. In the event any noncontributing wild symbol is detected as indicated by an affirmative outcome at decision box 418, the graphic for those wild symbols is changed as shown at process block 420. From this point, the process continues on to identify and award pay line wins and noncontributing wild symbol wins at process blocks 411 and 412.

It will be understood that although FIG. 4 omits any initialization step for initializing the gaming machine, at least some type of initialization is typically required before a gaming machine is in condition to receive a game play input. Methods according to the invention may be employed in gaming systems that utilize any gaming machine initialization process. For example, it may be necessary for a player to log in at a given gaming machine using a player identifier or player card in order to place the gaming machine in condition to receive a game play input to initiate a play in the game. As another example, it may only be necessary for a player to insert cash into the gaming machine or insert a cash-in ticket or otherwise place value on the gaming machine (that is, in memory associated with the gaming machine) to place the gaming machine in condition to receive a game play input to initiate a play in the game. The step or steps associated with initializing the gaming machine at the outset of play in the wagering game are omitted from FIG. 4 so as not to obscure the invention in unnecessary detail.

There may also be wide variation in the game play input received as indicated at process block 401. The input will at least be some signal which initiates a play in the game, such as a signal generated by a player activation of a play button or other control included in the player input system of the gaming machine. A player input may also include wager information, information regarding which pay lines are to be active for the play in the game, and perhaps other information. Also, the present invention is not limited to any particular type of wager which may be placed in the game. The wager may be of cash or some type of cash equivalent such as credits redeemable for cash. It is also possible for a wager to be in some non-monetary value, such as player loyalty points, or some other non-monetary value.

Although not shown in FIG. 4, the wagering game process may include a separate step of obtaining a game outcome to be displayed through the display system used to populate the various game symbol locations as indicated at process block 402. Obtaining a game outcome for the game play input may be performed in any number of ways. For example, an outcome may be obtained through a bingo game as in a class II gaming system, or may be obtained by drawing a lottery record as in some class III gaming systems. As another example, a gaming system may employ a centralized or local random outcome generator and the step of obtaining an outcome may include issuing a request to that outcome generator and receiving the generated outcome. The gaming machine may then interpret the received outcome as necessary and control the display system to generate a corresponding display graphic. The received outcome may indicate a certain prize in the reel-type game, and the gaming machine may then control mechanical or simulated (video-generated) reels to show game symbols arranged to pay that prize. In other implementations of a wagering game according to the invention, the gaming machine may randomly select a number of game symbols displayed at process block 402, and then any prize associated with those game symbols is identified from evaluating the display. This latter arrangement for obtaining a result for the game play input would be the case where the underlying game is a reel-type game utilizing independent random reel stops to identify a result for the game play input.

The process shown in FIG. 4 assumes that the various symbol locations of the array to be populated sequentially. Thus the step at process block 402 includes only populating a portion of the array of game symbol locations. Populating the various game symbol locations sequentially may be performed by sequentially stopping the various reels which provide the game symbols for the game. For example, in the first occurrence of the step at process block 402 for a given play of the game the "next portion" of the array may be the portion populated by bringing the first reel of the reel-type game to a stop. The next pass through block 402 for the play may populate the "next portion" of the array by stopping the next reel of the reel-type game. The number of reels stopped at a given pass-through process block 402 may be determined by the number of reels that must be stopped to determine whether any noncontributing wild symbols will be included in the array of game symbols. In the example game described below in connection with FIGS. 5-11, the first three reels of the game may be stopped on the first pass through process block 402 in FIG. 4. The invention is not limited to any particular portion of an array of game symbol locations to be populated at a given time for a play of a game. The portion may include from one symbol location to all symbol locations. Where all symbol locations are populated at once for a play of the game, the process would skip directly from the point of decision box 408 in FIG. 4 to the step at process block 411.

The nature of the search for noncontributing wild symbols according to process block 403 may depend upon how the outcome is obtained for the play in the wagering game. For example, in the case where an outcome is drawn from a lottery set, or obtained from the play of a bingo game, or obtained from a random outcome generator, the outcome may dictate the game symbols, including noncontributing wild symbols, to be displayed at the various locations of the array of game symbol locations. Thus it may be possible to detect noncontributing wild symbols from the outcome obtained for the play of the game. However, in cases where the gaming machine randomly stops each reel of the reel-type display and then evaluates the resulting array of game symbols to identify the result for the play of the wagering game, the searching step indicated at process block 403 includes searching for any wild symbols included in the portion of the array which is already populated and determining whether any of those wild symbols could potentially contribute to a pay line prize for the game.

Regardless of how noncontributing wild symbols are detected for a given implementation of the invention, the form of the invention indicated in FIG. 4 includes changing the wild symbol graphic to indicate that a given wild symbol represents a noncontributing wild symbol for that play of the game. This change of the wild symbol graphic at process block 407 may include any suitable graphic change which can make it clear to the player that the given wild symbol is not a standard wild symbol that will contribute to a pay line win, but is rather a noncontributing wild symbol according to the present invention. A simple example graphic change will be discussed below in connection with the example game presentations discussed in connection with FIGS. 5-11.

The anticipation reel stop shown at process block 416 may comprise bringing the final reel to a stop more slowly than the previous reels were stopped for the play of the game. In order to determine if an anticipation reel stop is desirable, it is necessary to distinguish between an array of game symbols which could potentially produce a noncontributing wild symbol prize and those that could not. Determining if a noncontributing wild symbol prize is possible may include identifying all wild symbols in the array displayed prior to stopping the final reel, determining the number of those wild symbols that represent noncontributing wild symbols, and comparing that number to the noncontributing wild symbol prize definitions defined for the game. For example, if it is necessary to obtain at least three noncontributing wild symbols in the array and if the last reel can show no more than one noncontributing wild symbol, then an array which includes less than two noncontributing wild symbols prior to stopping the final reel could not produce a noncontributing wild symbol prize.

The example shown in FIG. 4 indicates that the anticipation reel stop is performed in the event there is any potential for any noncontributing wild symbol prize. Other forms of the invention may produce the anticipation reel stop only for potential noncontributing wild symbol prizes over a certain prize level. Also, an anticipation reel stop may be performed in a game for reasons other than the potential for a noncontributing wild symbol prize according to the present invention. For example, the potential for some high-level pay line prize might also produce an anticipation reel stop. However, the process flow shown in FIG. 4 focusses on the process steps associated with the noncontributing wild symbols according to the invention and omits other process steps (such as anticipation reel stops for pay line wins) which may be included with a given implementation of the present invention. These steps not directly related to noncontributing wild symbol wins and prizes are omitted to avoid obscuring the present invention in unnecessary detail.

The manner in which pay line wins and noncontributing wild symbol wins are identified as indicated at process block 411 will again depend upon how the outcome is obtained for the play in the game. If the outcomes are obtained by randomly stopping each of the reels to show an array of game symbols, the identifying step at process block 411 will include evaluating the symbol shown at each location of the array (as dictated by the reel stop positions) and comparing the symbols with the pay line prize definitions and noncontributing wild symbol prize definitions defined for the game. Where the outcome for the play of the game is obtained from some central outcome server, a lottery or bingo game outcome, or a random outcome generator at the gaming machine, the pay line wins and noncontributing wild symbol wins may be identified from that outcome. The invention encompasses any suitable arrangement for identifying pay line wins and noncontributing wild symbol wins which is consistent with the way in which the outcome is determined for the play of the game.

The awarding step shown at process block 412 in FIG. 4 may be accomplished, for example, by increasing a credit meter at the gaming machine by an amount correlated to the prize which has been won. This may be done under the control of a processor (such as processor 205 in FIG. 2) at the gaming machine or a remote processor. Alternatively, the gaming machine may issue currency or some currency equivalent for the prize which has been won, issue some physical object, or some other type of value or benefit. Cash prizes and some other types of physical prizes may be dispensed by a suitable mechanism at the gaming machine, and large value prizes of any type may be awarded via a hand pay process as is known in the art. The invention is not limited to any particular arrangement or method of awarding prizes at process block 412 in FIG. 4.

Figure 5:
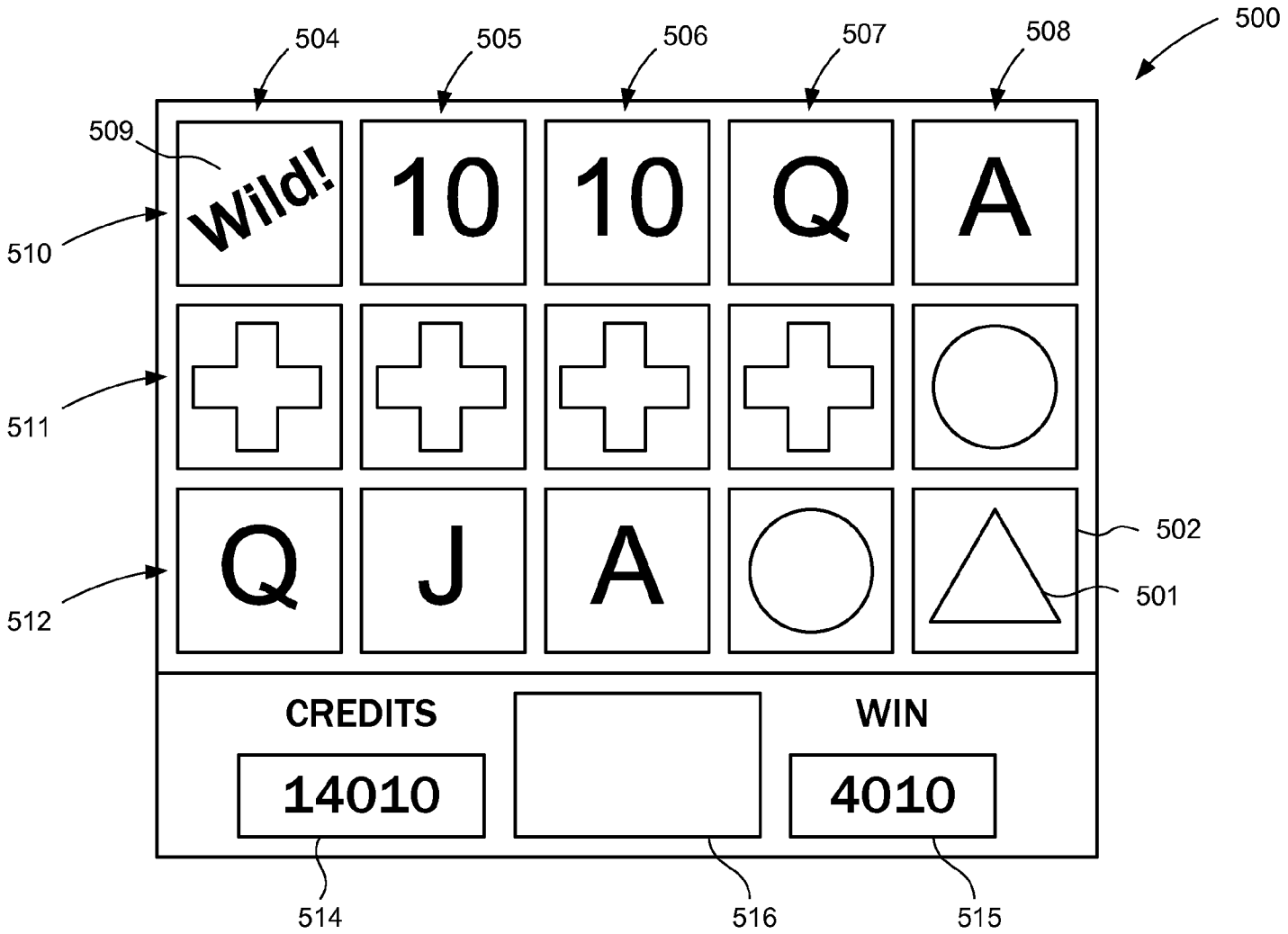
FIG. 5 is a diagrammatic representation of a game presentation including a game symbol array which may be produced for a play in a game embodying the principles of the present invention.

FIG. 5 shows a game presentation 500 that may be used in connection with FIG. 4 to describe an example process according to the present invention. Game presentation 500 includes an array of game symbols 501 at various symbol locations 502. The example array of game symbols 501 is defined by five columns of symbol locations, columns 504 through 508, and three rows of symbol locations, rows 510 through 512. It should be assumed for the purposes of this example that each column 504 through 508 of symbol locations is shown by a respective mechanical or video simulated reel. Thus this example array includes five reels with each reel defining a vertical line of symbol locations 502, with each location populated by a particular game symbol 501. The various types of game symbols 501, the star symbol, plus symbol, circle symbol, and triangle symbol as well as the "A" through "10," that is, Ace through 10 symbols are shown only for purposes of example. This example game set includes one standard wild symbol graphic 509 which happens to be shown in the top row 510 of column 504.

The physical or simulated reels defining columns 504 through 508 all aligned along a horizontal rotational axis and rotate (or appear to rotate in the case of simulated reels) about that axis to change the symbols in the array. Typically the physical or simulated reels would be spun rapidly for a play in the game (such as a play initiated by the play input received at 401 in FIG. 4) and then slowly brought to a stop to produce an initial game symbol array. Although not necessary to the invention, the reels defining columns 504 through 508 will be stopped in this example sequentially beginning with the reel defining column 504. Stopping the reels sequentially facilitates the anticipation reel stop described below in connection with FIG. 11.

It will be appreciated that the invention may be employed with numerous different types of game symbol arrays in addition to the simple array shown in FIG. 5. For example, the array of game symbols need not be a rectangular array as shown in FIG. 5. Furthermore, not all locations may be populated for given array. That is, there may be blanks in the symbol arrays. It is also possible for the physical or simulated reels to have half stop positions in which symbols straddle the symbol locations shown in FIG. 5. Also, physical or simulated reels need not rotated about a horizontal axis. The array shown in FIG. 5 may alternatively be produced by three reels aligned along the vertical axis that rotate left to right or right to left about that axis to change the symbols at the various symbol locations of the array. It is also possible for an implementation of the invention to include a separate reel for each symbol location.

Game presentation 500 also includes a display area 514 showing credits available to the player, and a display area 515 showing credits which have been won for the current play. Display area 516 is included to track the number of noncontributing wild symbols which are accumulated on a given play of the game as will be described below. This illustrated game presentation is a very simple presentation intended to facilitate describing an example of the invention without referring to additional details which are not necessary for an understanding of the present invention. Other game presentations within the scope of the invention may include numerous other types of information including game denomination, total wager for the most current play, various controls and various informational displays.

Figure 6:
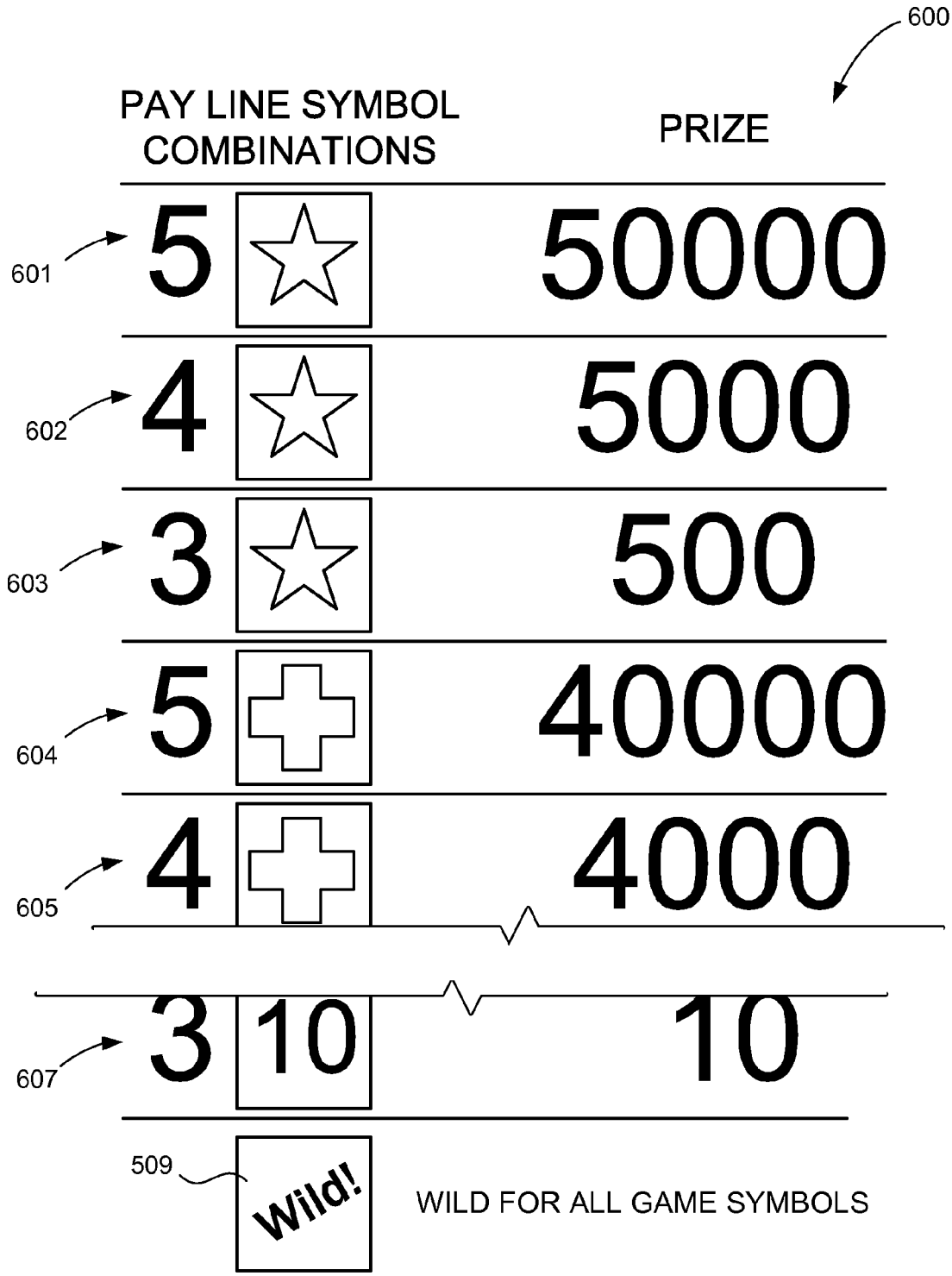
FIG. 6 is a diagrammatic representation of a portion of a pay table for the game presentation shown in FIG. 5.

FIG. 6 shows a portion of a very simplified pay table 600 that may be used in connection with the game presentations in FIGS. 5 and 8-11 to describe a process according to the present invention. Pay table 600 includes a number of win levels 601-605 and 607. Each win level includes a winning symbol combination and a prize value correlated to that winning symbol combination. For example, win level 601 includes a winning symbol combination of five "Star" symbols and this winning symbol combination corresponds to a prize of 50,000 credits. Pay table 600 also shows standard wild symbol graphic 509 and indicates that the standard wild symbol is wild for all game symbols, that is, for the star, plus sign, circle, and triangle game symbols as well as the "A" through "10" game symbols. It is not necessary according to the invention for a standard wild symbol to be wild for all game symbols. Some implementations of the invention may have multiple different standard wild symbols, each with different properties for representing other game symbols in the course of a play in the game.

Figure 7:
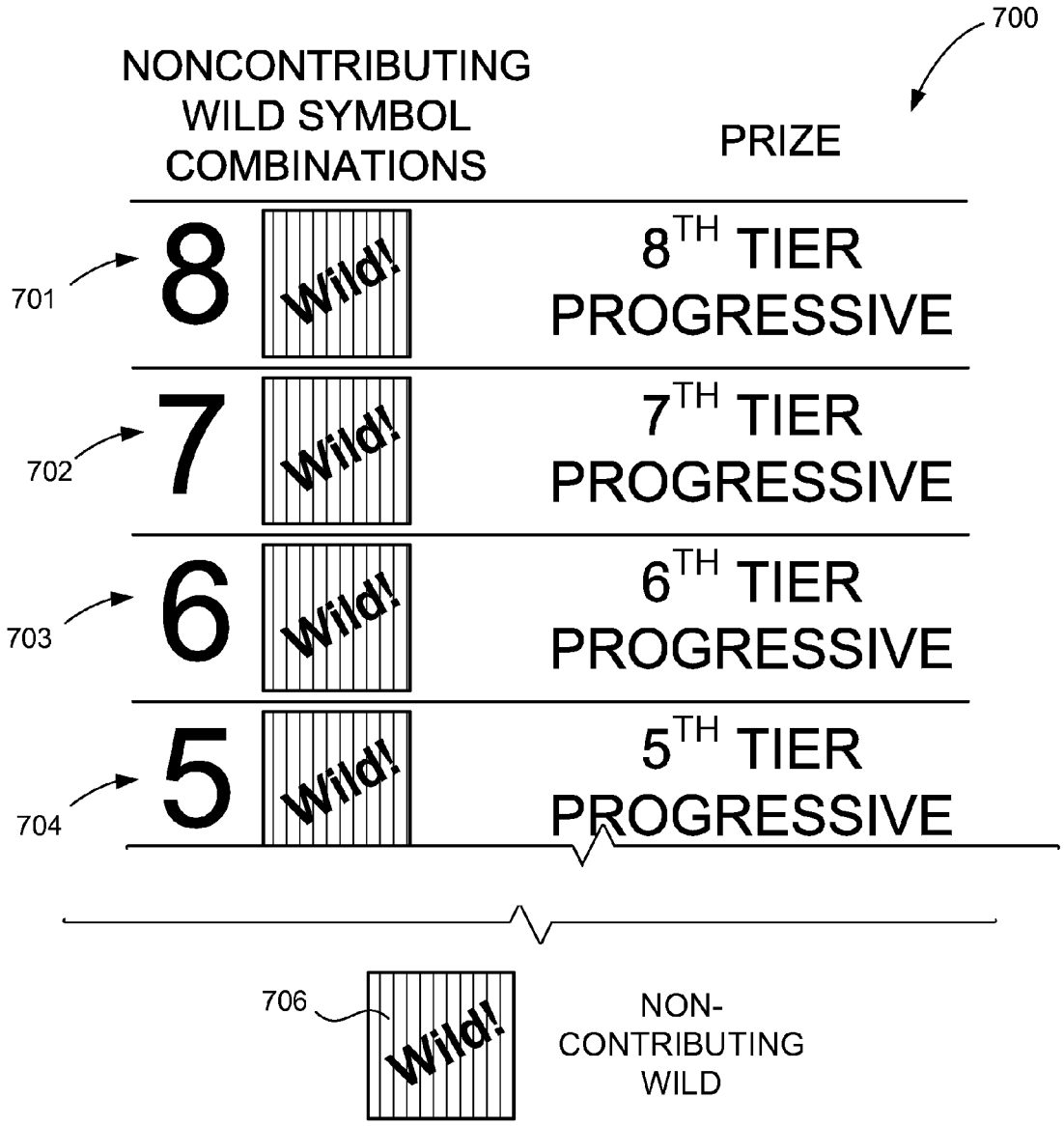
FIG. 7 is a diagrammatic representation of another portion of a pay table for the game presentation shown in FIG. 5.

FIG. 7 shows a portion of another pay table 700 which is applicable to the example game presentations in FIGS. 5 and 8-11. Pay table 700 shows a noncontributing wild symbol graphic 706 and defines various sets of noncontributing wild symbols that each correlate to a respective noncontributing wild symbol prize. The portion of pay table 700 shown in FIG. 7 includes a win level 701 defined by a set of eight noncontributing wild symbols shown in a given array of game symbols produced for a play of the game. Win level 701 correlates to a prize defined as an eighth tier progressive prize, which may be a top tier progressive prize. The other win levels, 702, 703, and 704, each define a different set of noncontributing wild symbols, and are correlated with a respective progressive prize tier. It will be appreciated that the number of noncontributing wild symbols 706 needed for the illustrated win levels 701-704 are just examples used here to illustrate the present invention. The noncontributing wild symbol wins for a given implementation of the present invention may be defined in any suitable fashion and are not limited to the illustrated examples. Also, it is not necessary for the noncontributing wild symbol prizes to be progressive prizes. A prize defined for a given set of noncontributing wild symbols may be a fixed value, a progressive value, or a value defined in any other way.

For the purpose of the examples which will be discussed in connection with FIGS. 5-11, it will be assumed that all winning symbol combinations must appear from left to right and start at the first symbol column 504. It will also be assumed that only three pay lines are defined through the game symbol array, each pay line corresponding to a respective row of symbol locations 510, 511, and 512. Each pay line will be assumed to be active for the illustrative play in the game.

With these assumptions for our examples, the condition of the array in FIG. 5 may be assumed to be a game symbol array present at the termination of the previous play. That play happened to produce two winning symbol combinations, a combination of three "10" symbols along the pay line defined by row 510, and a combination of four "+" symbols along the pay line defined by row 511. These winning pay line combinations result in the award of 10 credits and 4000 credits, respectively. The total win of 4010 credits for the play shows in display area 515. It should be noted that the winning combination of three "10" symbols in FIG. 5 is produced with the aid of a wild symbol shown by wild symbol graphic 509 in the first column of row 510. That is, this wild symbol performs its wild function in the array shown in FIG. 5 and is taken as another "10" symbol to contribute to the winning combination of three "10" symbols.

The condition of the array shown in FIG. 5 can also be taken as the condition of the array at the time a player enters a play input for the game at the gaming machine which implements the invention. From this point the gaming machine receives a new play input from a player corresponding to the step indicated at process block 401 FIG. 4. This play input ultimately causes the reels defining columns 504 through 508 in FIG. 5 to spin rapidly and then slow down and stop to produce the game symbol array ultimately shown in FIG. 11. However, our example game presentation causes the reels defining columns 504 through 508 to come to a stop sequentially from left to right. Thus for the play in the game, the reel defining column 504 would stop spinning ("land") first, then the reel defining column 505, and so forth.

Figure 8:
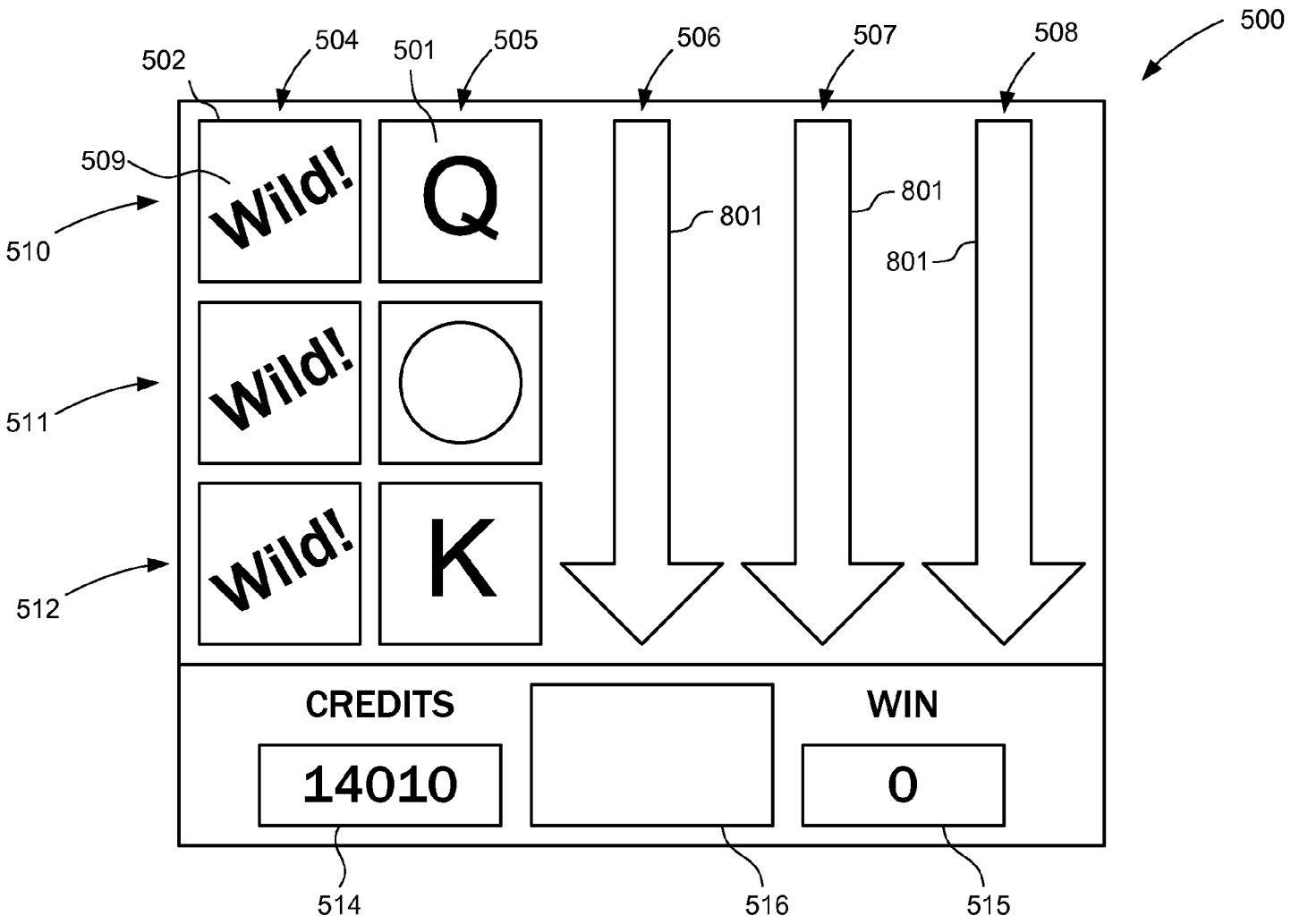
FIG. 8 is a diagrammatic representation of the game presentation shown in FIG. 5 after the first two reels have stopped after a play in the game has been initiated to produce a new outcome in the game.

FIG. 8 shows the condition of the array 500 after the respective reel defining the first two columns, 504 and 505, have come to a stop for the play of the game. The reel defining column 506 is still spinning as indicated by arrow 801, as are the reels defining columns 507 and 508. In the state of the array of game symbols 501 shown in FIG. 8, it is still possible for each of the wild symbols in column 504 to contribute to a respective pay line win depending upon the symbols that ultimately populate the symbol locations making up column 506. Thus the wild symbols are shown by the standard wild symbol graphic 509. Referring to the process flow shown in FIG. 4, the condition of the array shown in FIG. 8 represents a condition producing a negative outcome at decision box 408. That is, the play input for the play in the game has been received as indicated at process block 401 in FIG. 4, and the first two columns of the array have been populated according to process block 402. The search for noncontributing wild symbols at process block 403 has come up empty and the next reel to land will not be the final reel for the array. Thus the process loops back to process block 402 in FIG. 4 for the next portion of the array to populate.

Figure 9:
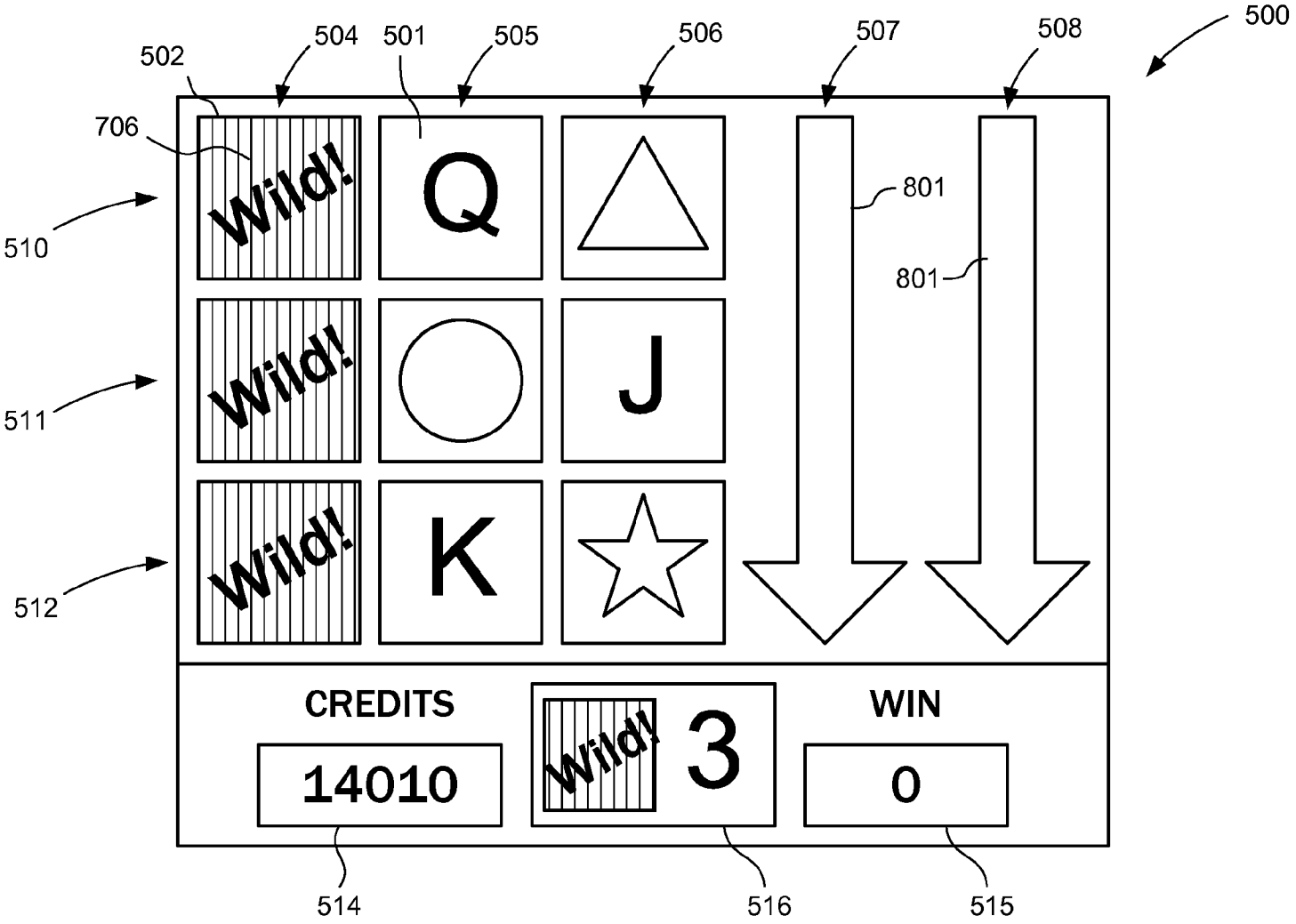
FIG. 9 is a diagrammatic representation of the game presentation shown in FIG. 8 after a third reel has stopped in the course of producing an array of game symbols to show an outcome in the game.

FIG. 9 shows the condition of presentation 500 after the reel defining column 506 has been brought to a stop for the play of the game, while the reels defining columns 507 and 508 remain spinning as indicated by arrows 801. Under the assumptions we are using for this example, it is apparent once column 506 is populated with game symbols for the play in the game whether the wild symbols showing in column 504 in FIG. 8 will contribute to a pay line win for this play of the game. In the example of FIG. 9, the game symbols 501 landing in column 506 do not produce any winning combination of game symbols along the respective pay line (rows 510, 511, and 512) according to the pay table 600 (FIG. 6) defined for the game. Thus, in this implementation of the invention, the standard wild symbol graphic 509 shown for each wild symbol in FIG. 8 has been changed to noncontributing wild symbol graphic 706 in the array shown in FIG. 9. This particular implementation tracks how many noncontributing wild symbols have been accumulated in display area 516. In this case, display area 516, which may flash or be animated or accented in some other way, indicates that three noncontributing wild symbols 706 have landed for that play of the game. This tracking arrangement in display area 516 is shown only as a simple example. Any suitable graphic arrangement may be used to communicate to the player how many noncontributing wild symbols have landed for the play, or a tracking display may be omitted from embodiments of the invention. The condition of presentation 500 shown in FIG. 9 is a condition that would occur after a loop through 402, 403, 405, 407, and 408 in the process of FIG. 4. In this example, the standard wild symbols shown in FIG. 8 with graphic 509 became noncontributing wild symbols once column 506 was populated in FIG. 9. These noncontributing wild symbols were detected and then each standard wild symbol graphic 509 was changed to the noncontributing wild symbol graphic 706 in accordance with process block 407 in FIG. 4. Since the next reel to stop is not the final reel in the state of presentation 500 shown in FIG. 9, the process shown in FIG. 4 loops back from decision box 408 to block 402 at which point the next portion of the game symbol array is populated.

The manner in which the standard wild symbol graphic 509 changes to the noncontributing wild symbol graphic may vary widely within the scope of the present invention. It is also possible that the graphics do not change between a standard wild symbol graphic and noncontributing wild symbol graphic in some implementations of the present invention. A standard wild symbol in a given array becomes a noncontributing wild symbol when it fails to contribute to a pay line prize regardless of whether there is any change of the graphic representing the standard wild symbol. However, some preferred forms of the invention include a distinctive graphic change, perhaps including some sort of animation and highlighting in the array or elsewhere (such as in display area 516), to indicate to the player during the course of the play that noncontributing wild symbols are accumulating and may lead to a prize.

Figure 10:
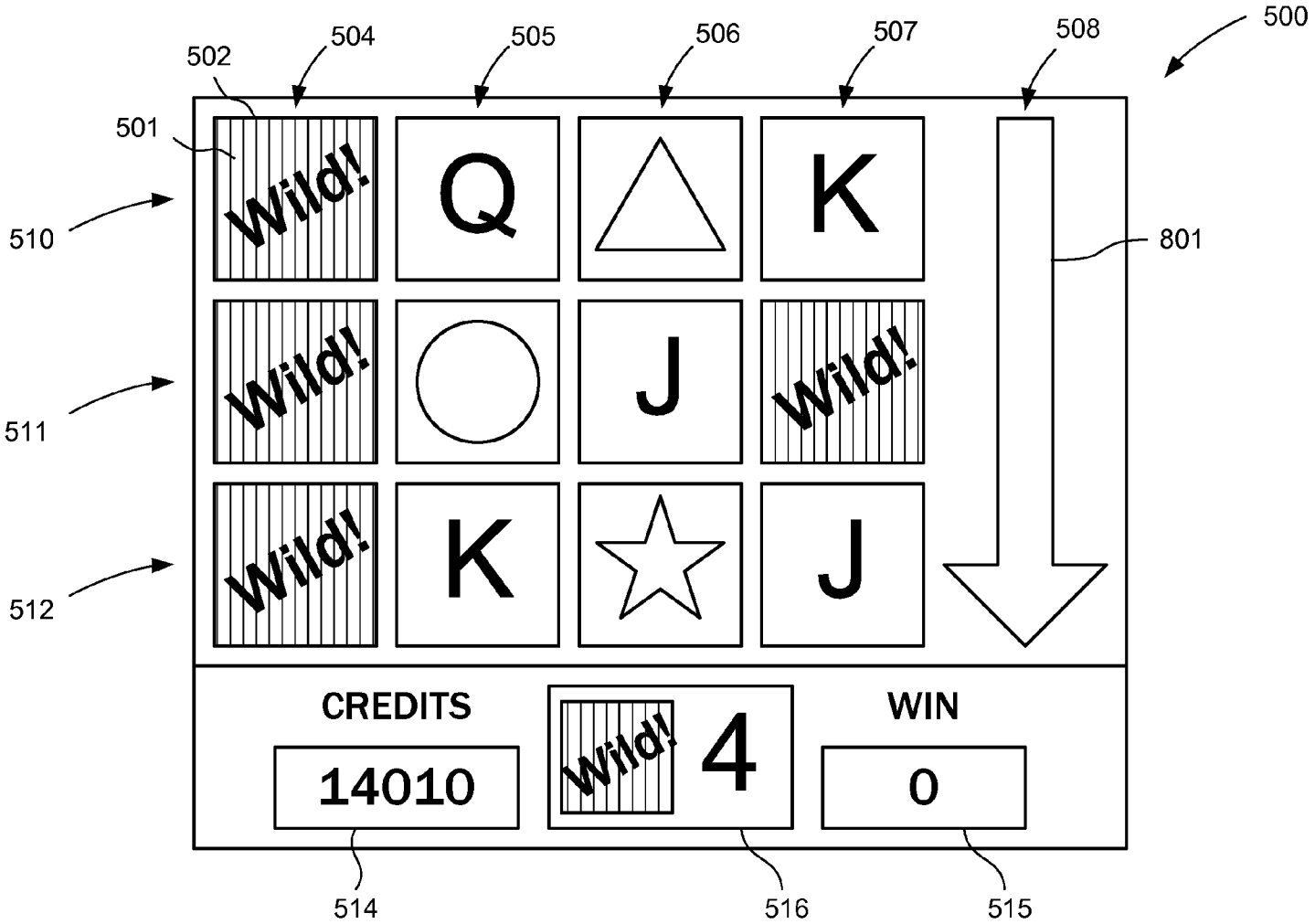
FIG. 10 is a diagrammatic representation of the game presentation shown in FIG. 9 after a fourth reel has stopped for the play of the game.

The example of FIG. 10 shows the state of presentation 500 after column 507 has been populated with game symbols, while the reel defining column 508 remains spinning as indicated by arrow 801. In this case, an additional wild symbol has landed in the middle row position of column 507, has been detected, and the graphic has changed from standard wild symbol graphic 509 to noncontributing wild symbol graphic 706. Display area 516 has also been updated to show the number of noncontributing wild symbols that have landed for the game play. In accordance with the process shown in FIG. 4, an affirmative outcome is produced at decision box 408 since the next reel to stop is the final reel forming the array of game symbol locations. Also, since there is the potential for a noncontributing wild symbol win in this play of the game, the gaming machine would produce an anticipation reel stop as indicated at 416 in FIG. 4, which may include bringing the reel for column 508 to a stop more slowly than for the previous reels, flashing or otherwise emphasizing the noncontributing wild symbol graphics 706, or both.

Figure 11:
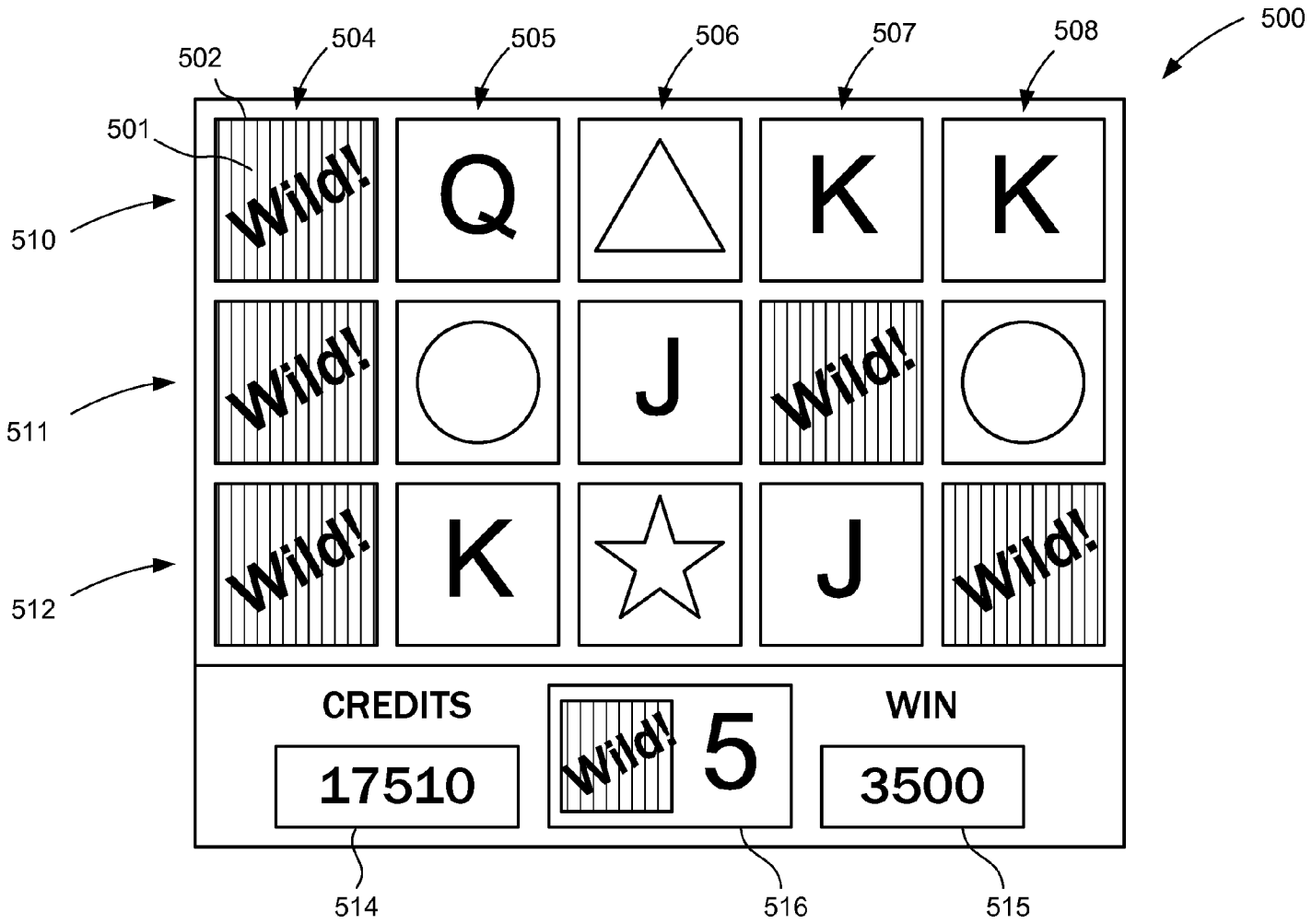
FIG. 11 is a diagrammatic representation of the game presentation shown in FIG. 10 after a final reel has stopped for the play of the game.

The example of FIG. 11 shows the state of game presentation 500 after the reel defining column 508 has been brought to a stop to populate the remaining symbol locations in the array. In this example, a fifth noncontributing wild symbol has landed in column 508 as indicated by the noncontributing wild symbol graphic 706 appearing in the bottom row location of column 508. This set of five noncontributing wild symbols represents a winning set of such symbols according to pay table 700 in FIG. 7, and entitles the player to the fifth tier progressive prize. It is assumed for purposes of this example that the fifth tier progressive prize is 3500 credits. The credit amount is thus shown in display area 515 in FIG. 11, and the amount is added to the player's total credits shown in display area 514 in FIG. 11. This adding credits to the player's total credits represents the award of the noncontributing wild symbol prize in accordance with process block 412 in FIG. 4. Identifying that win was performed in accordance with process block 411 in FIG. 4.

The example shown in FIG. 11 includes only a noncontributing wild symbol win shown by a set of five noncontributing wild symbols indicated by graphic symbols 706. It is possible, however, for there to have been both pay line wins and a noncontributing wild symbol win. For example, all of the noncontributing wild symbols might be limited to the bottom two rows, 511 and 512, and a pay line prize might be awarded for a winning pay line combination along row 510.

The invention encompasses numerous variations on applying noncontributing wild symbols to provide additional prizes for a play of a gaming machine. For example, the noncontributing wild feature described herein may not be available for every play of the game. In some implementations, it may be necessary for the player to place an additional wager for a given play of the game in order to activate the noncontributing wild feature. Also, the noncontributing wild feature may itself be a prize which is awarded to a player for one or more plays of the game. For example, the noncontributing wild feature may be activated as a pay line prize in the game or as part of a pay line prize, or may be activated as some other prize, or may be activated after some consecutive number of plays at a gaming machine by a single player. The nonconforming wild feature may also be activated through points earned by the player in a loyalty program.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for operating a gaming machine, the method including:

(a) receiving a value deposit from a player through a currency/voucher acceptor on the gaming machine, and receiving from the player a play input through a player input system of the gaming machine, the play input initiating a play in a wagering game;

(b) in the play in the wagering game, controlling a display system of the gaming machine to populate at least some game symbol locations of an array of game symbol locations, each of the at least some game symbol locations being populated with a respective game symbol selected from a set of game symbols which includes a wild symbol, wherein the game symbol locations are divided into sets of game symbol locations and the sets of game symbol locations are populated sequentially with one or more respective sets of game symbol locations being populated at a first population rate;

(c) through the gaming machine, awarding a respective pay line prize for each winning combination of game symbols appearing along an active pay line defined through the array of game symbol locations for that play in the wagering game, each winning combination of game symbols being defined in a pay table for the wagering game in which each of a number of respective winning combinations of game symbols is associated with a respective prize for the wagering game;

(d) through the gaming machine, awarding a respective noncontributing wild symbol prize for one or more sets of noncontributing wild symbols meeting one of one or more noncontributing wild symbol prize definitions for the wagering game, wherein a noncontributing wild symbol comprises a wild symbol appearing in the populated array of game symbol locations for the play in the wagering game which is not included in any winning combination of game symbols appearing along an active pay line for the play in the wagering game, and causing the noncontributing wild symbol prize to be displayed by controlling the display system, and causing the noncontributing wild symbol prize to be awarded as a value credit to the player; and (e) wherein controlling the display system to populate at least some of the game symbol locations includes (i) after a respective wild symbol populates one of the symbol locations for the play of the wagering game, changing the graphic appearance of that wild symbol from a standard wild symbol graphic to a noncontributing wild symbol graphic in the event that wild symbol meets the noncontributing wild symbol definition for the play in the wagering game, and (ii) populating a final one of the sets of game symbol locations at a second population rate lower than the first population rate in the event a predefined number of noncontributing wild symbols have already populated the game symbol locations for the play of the wagering game.

2. The method of claim 1 further including detecting the one or more sets of noncontributing wild symbols which (i) populates the array of game symbol locations for the play of the wagering game, and which (ii) meets one of the one or more noncontributing wild symbol prize definitions for the wagering game.

3. The method of claim 1 further including maintaining a first progressive prize tier for the wagering game and wherein the first progressive prize tier is defined as a prize for a first one of the one or more noncontributing wild symbol prize definitions.

4. The method of claim 3 further including maintaining a second progressive prize tier for the wagering game and wherein the second progressive prize tier is defined as a prize for a second one of the one or more noncontributing wild symbol prize definitions.

5. The method of claim 1 further including maintaining a number of progressive prize tiers for the wagering game and wherein each respective progressive prize tier is defined as a prize for a respective one of the one or more noncontributing wild symbol prize definitions.

6. A reel-type gaming machine including:

(a) a display system;

(b) a player input system including a currency/voucher acceptor on the gaming machine;

(c) at least one processor; and (d) at least one memory device storing instructions executable by the at least one processor to:

(i) receive a value deposit from a player through the currency/voucher acceptor, and receive a play input through the player input system, the play input initiating a play in a wagering game;

(ii) in the play in the wagering game, control the display system to populate at least some game symbol locations of an array of game symbol locations, each of the at least some game symbol locations being populated with a respective game symbol selected from a set of game symbols which includes a wild symbol, wherein the game symbol locations are divided into sets of game symbol locations and the sets of game symbol locations are populated sequentially with one or more respective sets of game symbol locations being populated at a first population rate;

(iii) award a respective pay line prize for each winning combination of game symbols appearing along an active pay line defined through the array of game symbol locations for that play in the wagering game, each winning combination of game symbols being defined in a pay table for the wagering game in which each of a number of respective winning combinations of game symbols is associated with a respective prize for the wagering game;

(iv) award a respective noncontributing wild symbol prize for one or more sets of noncontributing wild symbols meeting one of one or more noncontributing wild symbol prize definitions for the wagering game, wherein a noncontributing wild symbol comprises a wild symbol appearing in the populated array of game symbol locations for the play in the wagering game which is not included in any winning combination of game symbols appearing along an active pay line for the play in the wagering game, causing the noncontributing wild symbol prize to be displayed by controlling the display system, and causing the noncontributing wild symbol prize to be awarded as a value credit to the player; and (v) wherein the control of the display system to populate at least some of the game symbol locations includes (i) after a respective wild symbol populates one of the symbol locations for the play of the wagering game, changing the graphic appearance of that wild symbol from a standard wild symbol graphic to a noncontributing wild symbol graphic in the event that wild symbol meets the noncontributing wild symbol definition for the play in the wagering game, and (ii) populating a final one of the sets of game symbol locations at a second population rate lower than the first population rate in the event a predefined number of noncontributing wild symbols have already populated the game symbol locations for the play of the wagering game.

7. The reel-type gaming machine of claim 6 wherein the instructions are also executable by the at least one processor to detect the one or more sets of noncontributing wild symbols which (i) populates the array of game symbol locations for the play of the wagering game, and which (ii) meets one of the one or more noncontributing wild symbol prize definitions for the wagering game.

8. The reel-type gaming machine of claim 6 wherein a first progressive prize tier is maintained for the wagering game and wherein the first progressive prize tier is defined as a prize for a first one of the one or more noncontributing wild symbol prize definitions.

9. The reel-type gaming machine of claim 8 wherein a second progressive prize tier is maintained for the wagering game and wherein the second progressive prize tier is defined as a prize for a second one of the one or more noncontributing wild symbol prize definitions.

10. The reel-type gaming machine of claim 6 wherein the instructions are also executable by the at least one processor to maintain a number of progressive prize tiers for the wagering game and wherein each respective progressive prize tier is defined as a prize for a respective one of the one or more noncontributing wild symbol prize definitions.

11. A program product comprising program code stored on one or more non-transitory computer readable data storage devices, the program code including:

(a) player input program code executable by at least one processor to receive a game play input entered through a player input system of a gaming machine to initiate a play in a wagering game;

(b) game program code executable by the at least one processor to, in the play in the wagering game, cause a display system of the gaming machine to populate at least some game symbol locations of an array of game symbol locations which are divided into sets of game symbol locations, each of the at least some game symbol locations being populated with a respective game symbol selected from a set of game symbols which includes a wild symbol;

(c) award program code executable by the at least one processor to:

(i) cause the gaming machine to award a respective pay line prize for each winning combination of game symbols appearing along an active pay line defined through the array of game symbol locations for that play in the wagering game, each winning combination of game symbols being defined in a pay table for the wagering game in which each of a number of respective winning combinations of game symbols is associated with a respective prize for the wagering game; and (ii) cause the gaming machine to award a respective noncontributing wild symbol prize for one or more sets of noncontributing wild symbols meeting one of one or more noncontributing wild symbol prize definitions for the wagering game, wherein a noncontributing wild symbol comprises a wild symbol appearing in the populated array of game symbol locations for the play in the wagering game which is not included in any winning combination of game symbols appearing along an active pay line for the play in the wagering game, cause the noncontributing wild symbol prize to be displayed by controlling the display system, and cause the noncontributing wild symbol prize to be awarded as a value credit to the player; and (d) wherein the game program code is also executable to control the display system to (i) after a respective wild symbol populates one of the symbol locations for the play of the wagering game, change the graphic appearance of that wild symbol from a standard wild symbol graphic to a noncontributing wild symbol graphic in the event that wild symbol meets the noncontributing wild symbol definition for the play in the wagering game, to (ii) populate the sets of game symbol locations sequentially with one or more respective sets of game symbol locations being populated at a first population rate, and to (iii) populate a final one of the sets of game symbol locations at a second population rate lower than the first population rate in the event a predefined number of noncontributing wild symbols have already populated the game symbol locations for the play of the wagering game.

12. The program product of claim 11 wherein the game program code is also executable to detect the one or more sets of noncontributing wild symbols which (i) populates the array of game symbol locations for the play of the wagering game, and which (ii) meets one of the one or more noncontributing wild symbol prize definitions for the wagering game.

13. The program product of claim 11 further including progressive game program code executable by the at least one processor to maintain a first progressive prize tier for the wagering game and wherein the first progressive prize tier is defined as a prize for a first one of the one or more noncontributing wild symbol prize definitions.

14. The program product of claim 11 wherein a number of progressive prize tiers are maintained for the wagering game and wherein each respective progressive prize tier is defined as a prize for a respective one of the one or more noncontributing wild symbol prize definitions.

* * * * *